US007426280B2

(12) United States Patent
Aylward

(10) Patent No.: US 7,426,280 B2
(45) Date of Patent: Sep. 16, 2008

(54) ELECTROACOUSTIC WAVEGUIDE TRANSDUCING

(75) Inventor: J. Richard Aylward, Ashland, MA (US)

(73) Assignee: Bose Corporation, Farmingham, MA (US)

( * ) Notice: Subject to any disclaimer, the term of this patent is extended or adjusted under 35 U.S.C. 154(b) by 685 days.

(21) Appl. No.: 09/753,167

(22) Filed: Jan. 2, 2001

(65) Prior Publication Data

US 2002/0085731 A1 Jul. 4, 2002

(51) Int. Cl.
*H04R 1/20* (2006.01)
*H04R 1/02* (2006.01)

(52) U.S. Cl. ..... 381/338; 381/337; 381/352

(58) Field of Classification Search ..... 381/338, 381/337, 345–349, 352, 71.5, 340, 162, 181, 381/152, 192, 342
See application file for complete search history.

(56) References Cited

U.S. PATENT DOCUMENTS

| | | | | | |
|---|---|---|---|---|---|
| 4,509,184 | A * | 4/1985 | Yanagawa | 381/308 |
| 4,628,528 | A * | 12/1986 | Bose et al. | 381/335 |
| 4,933,982 | A * | 6/1990 | Tanaka | 381/349 |
| 5,588,063 | A * | 12/1996 | Edgar | 381/300 |
| 5,590,208 | A * | 12/1996 | Koyano et al. | 381/338 |
| 6,002,781 | A * | 12/1999 | Takayama et al. | 381/338 |
| 6,201,872 | B1 * | 3/2001 | Hersh et al. | 381/71.5 |

FOREIGN PATENT DOCUMENTS

| | | |
|---|---|---|
| EP | 0 744 880 A1 | 11/1996 |
| EP | 0744 880 A1 | 11/1996 |
| FR | 2 770 734 | 5/1999 |
| JP | 02-302199 | 12/1990 |
| JP | 03 022796 | 1/1991 |
| JP | 2-11941 | 9/1991 |
| JP | 03-217199 | 9/1991 |
| JP | 08-331685 | 12/1996 |

OTHER PUBLICATIONS

Foreign communications from Japanese counterpart application dated Oct. 27, 2003 (12 pages).
English translation of Foreign communication from Chinese counterpart application (7 pages).
Official Office Action from Japanese counterpart application No. 2001-399799, dated Oct. 3, 2003 (3 pages).
Official Office Action from Chinese counterpart application No. 01145310.9, dated Feb. 10, 2006 with English Translation (31 pages).

* cited by examiner

*Primary Examiner*—Xu Mei
(74) *Attorney, Agent, or Firm*—Fish & Richardson P.C.

(57) ABSTRACT

An acoustic waveguide system, having source of acoustic radiation and a source of opposing acoustic radiation. An acoustic waveguide has an open end and an interior. A first acoustic driver having a first radiating surface and a second radiating surface is arranged and constructed so that the first radiating surface radiates sound waves into free air and the second radiating surface radiates sound waves into the acoustic waveguide so that sound waves are radiated at the open end. A source of opposing sound waves in the acoustic waveguide opposes a predetermined spectral component of the sound waves radiated into the acoustic waveguide to reduce the acoustic radiation of the predetermined spectral component from the acoustic waveguide.

12 Claims, 5 Drawing Sheets

ELECTROACOUSTIC WAVEGUIDE TRANSDUCING

CROSS-REFERENCE TO RELATED APPLICATIONS

Not applicable.

FEDERALLY SPONSORED RESEARCH OR DEVELOPMENT

Not applicable.

BACKGROUND OF THE INVENTION

For background, reference is made to U.S. Pat. No. 4,628,528, copending application Ser. No. 09/146,662 filed Sep. 3, 1998, now U.S. Pat. No. 6,771,787, for WAVEGUIDE ELECTROACOUSTICAL TRANSDUCING and the commercially available Bose Wave radio, Wave radio/CD and ACOUSTIC WAVE music systems incorporated herein by reference.

BRIEF SUMMARY OF THE INVENTION

It is an important aspect of the invention to provide improved electroacoustic waveguide transducing.

According to the invention, an electroacoustic waveguide transducing system includes an acoustic waveguide having an open end and an interior. A first acoustic driver or electroacoustic transducer has a first radiating surface that radiates sound waves into free air and a second radiating surface that radiates sound waves into the acoustic waveguide so that sound waves are radiated through the open end into free air that would ordinarily oppose the radiation from the first surface at a dip frequency. There is a source of opposing sound waves in the acoustic waveguide for opposing the acoustic radiation of a predetermined spectral component corresponding to said dip frequency of said sound waves radiated into the acoustic waveguide to oppose the acoustic radiation of the predetermined spectral component from the acoustic waveguide so that the combined radiation into free air from the first radiated surface and the open end is free from appreciable reduction in radiation at the dip frequency.

In another aspect of the invention, the electroacoustic driver is positioned in the acoustic waveguide so that there is null at a null frequency.

In another aspect of the invention, there are a plurality of electroacoustic transducers. A first of the acoustic drivers is placed in the wall of the acoustic waveguide. The transducers are placed in the waveguide typically separated by half the effective acoustic waveguide wavelength.

In another aspect of the invention, there is an acoustic low-pass filter, coupling the electroacoustic transducer and the acoustic waveguide.

In still another aspect of the invention, a method for operating an acoustic waveguide having an open end and a closed end and a wall connecting the open end and the closed end, includes radiating acoustic energy into the acoustic waveguide and significantly attenuating acoustic radiation at the frequency at which the wavelength is equal to the effective wavelength of the acoustic waveguide.

Other features, objects, and advantages will become apparent from the following detailed description, which refers to the following drawing in which:

DETAILED DESCRIPTION

Figure 1:
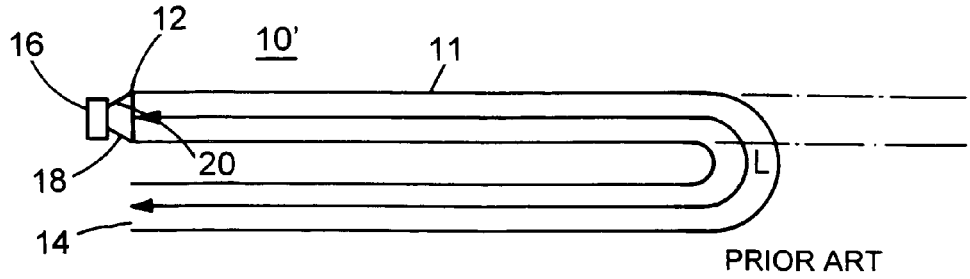
PRIOR ART FIG. 1
FIG. 1 is a diagrammatic cross section of a prior art electroacoustic waveguide transducer characterized by a dip frequency.

With reference now to the drawing and more particularly to FIG. 1, there is shown a prior art electroacoustical waveguide transducing system helpful in understanding acoustic waveguide transducing. Electroacoustical waveguide transducing system 10' includes an acoustic waveguide 11 that has a terminal end 12 and an open end 14. Mounted in the waveguide, at terminal end 12, is electroacoustical driver 16. When electroacoustical driver 12 radiates a sound wave, it radiates a front wave into free air surrounding the waveguide and a back wave into the waveguide. At some first frequency $f$ herein referred to as the "dip frequency," above the quarter-wave resonance frequency, the combined output of the waveguide and the output of the free air radiation have a phase and amplitude relation such that the combined output of the waveguide system has a "dip" or local minimum, herein referred to as an "acoustic dip." If the waveguide has a constant cross section, the dip frequency is approximately the frequency corresponding to a wave with a wavelength equal to the effective wavelength (including end effects) of the waveguide. If the waveguide does not have a constant cross section, the dip frequency may be determined by mathematical calculation, computer modeling, or empirically. In a constant cross section waveguide, a similar dip occurs when the sound waves have a frequency of a multiple of $f$, such as $2f$, $3f$, $4f$, $5f$ (so that the wavelength L=2 wavelengths, 3 wavelengths, 4 wavelengths, 5 wavelengths and so on). In a waveguide having a varying cross section, a similar acoustic dip occurs at a frequency $f$ and at multiples of frequency $f$, but the multiples may not be integer multiples off and the "dip" may not have the same steepness, width, or depth as the "dip" at frequency $f$. Typically, the dip at frequency $f$ is the most significant.

Figure 2:
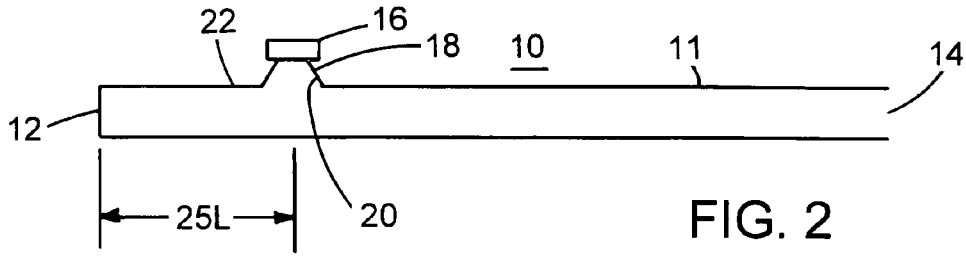
FIG. 2 is a diagrammatic cross section of an electroacoustical waveguide transducing system according to the invention.

Referring now to FIG. 2, there is shown an electroacoustical waveguide system 10 according to the invention. Waveguide system 10 includes an acoustic waveguide 11 that is a tubular structure that has a terminal end 12 and an open end 14. An "acoustic waveguide" as used herein, is similar to the tube or low loss acoustic transmission line disclosed in U.S. Pat. No. 4,628,528 or in the Bose Wave radio/CD. Terminal end 12 is terminated by an acoustically reflective surface. Mounted in a wall 22 of waveguide 11 is an acoustic energy source, in this case, an acoustic driver 16. Acoustic driver 16 has one radiating surface (in this case back side 18) of the acoustic driver facing free air and the other side (in this case front side 20) of the acoustic driver facing into acoustic waveguide 11. Acoustic driver 16 is mounted at a point such that the reflected sound wave in the waveguide is out of phase with the unreflected radiation in the waveguide from the acoustic driver and therefore the unreflected and reflected radiation oppose each other. As a result of the opposition, there is significantly reduced radiation from acoustic waveguide 11. Since there is significantly reduced radiation from the acoustic waveguide 11, the sound waves radiated into free air by the back side 16 of acoustic driver 16 are not opposed by radiation from waveguide 11, and the null at the dip frequency $f$ at which the wavelength equal L (and at the even multiples of frequency f) is greatly reduced. In a waveguide of substantially constant cross section, if acoustic driver 16 is placed at a point 0.25 L, where L is the effective length of the waveguide including end effects, from the terminal end 12 of the waveguide, the reflected sound wave is out of phase with the unreflected radiation from the acoustic driver at the dip frequency.

Figure 3:
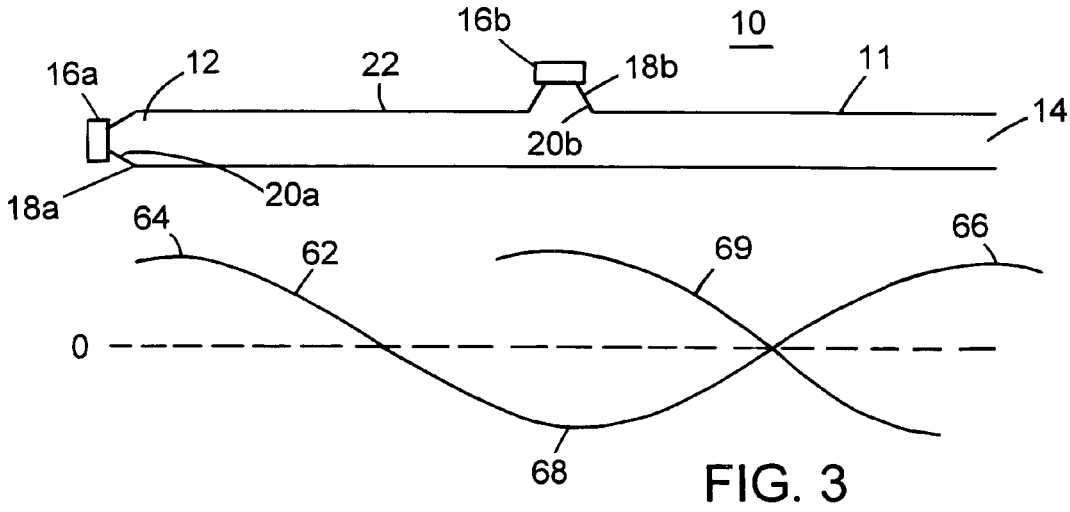
FIG. 3 is a diagrammatic cross section of second embodiment of the invention with a plot of pressure or volume velocity at points along the waveguide, for illustrating a feature of the invention.

Referring to FIG. 3, there is shown a second waveguide system according to the invention and a plot of pressure at points along the length of the waveguide. Waveguide system 10 includes an acoustic waveguide 11 that is a tubular structure that has a terminal end 12 and an open end 14. Acoustically coupled to the waveguide is an acoustic energy source, which, in the implementation of FIG. 3 includes two acoustic drivers 16*a* and 16*b*. First acoustic driver 16*a* is mounted in the terminal end 12, with one radiating surface (in this case back side 18*a*) of the first acoustic driver 16*a* facing free air and the other radiating surface (in this case front side 20*a*) of the first acoustic driver 16*a* facing into the acoustic waveguide 11. Second acoustic driver 16*b* is mounted in a wall 22 of the waveguide 11, with one radiating surface (in this case back side 18*b*) of the second acoustic driver 16*b* facing free air and the other radiating surface (in this case front side 20*b*) of the acoustic driver facing into the acoustic waveguide 11. The second acoustic driver 16*b* is mounted at the acoustic midpoint (as defined below) of the waveguide. First and second acoustic drivers 16*a* and 16*b* are connected in phase to the same signal source (signal source and connections not shown).

When first acoustic driver 16*a* radiates a sound wave with a wavelength equal to L, the pressure and volume velocity resulting from the radiation of driver 16*a* in the waveguide vary as curve 62, with the pressure (or volume velocity) in-phase and of approximately equal amplitude 64, 66, at the front side 20*a* of driver 16*a* and at the open end 14 of the waveguide 11. At a point 68 between front side 20*a* of the driver and the open end 14, the pressure or volume velocity is equal to, and out of phase with, the pressure or volume velocity at points 64, 66. Point 68 will be referred to as the effective midpoint or the acoustic midpoint of the waveguide. Second acoustic driver 16*b* is connected in phase to the same signal source as first acoustic driver 16*a*. When first acoustic driver 16*a* radiates a sound wave with a wavelength equal to L, second acoustic driver 16*b* also radiates a sound wave with a wavelength equal to L, the pressure or volume velocity resulting from driver 16*b* varies as curve 68, in phase opposition to curve 62. The pressure or volume velocity waves from the two acoustic drivers therefore oppose each other, and there is significantly reduced radiation from the acoustic waveguide 11. Since there is significantly reduced radiation from the acoustic waveguide 11, the sound waves radiated into free air by the back side 18*a* of first acoustic driver 16*a* and the back side 18*b* of second acoustic driver 16*b* are not opposed by radiation from the waveguide.

If the waveguide has little or no variation in the cross-sectional area of the waveguide 11 as in FIG. 3, the effective midpoint of the waveguide is typically close to the geometric midpoint of the waveguide. In waveguide systems in which the waveguide does not having a uniform cross-sectional area, the effective midpoint of the waveguide may not be at the geometric midpoint of the waveguide, as described below in the discussion of FIG. 7. For waveguides in which the waveguide does not have a uniform cross section, the effective midpoint may be determined by mathematical calculation, by computer modeling, or empirically.

Figure 4:
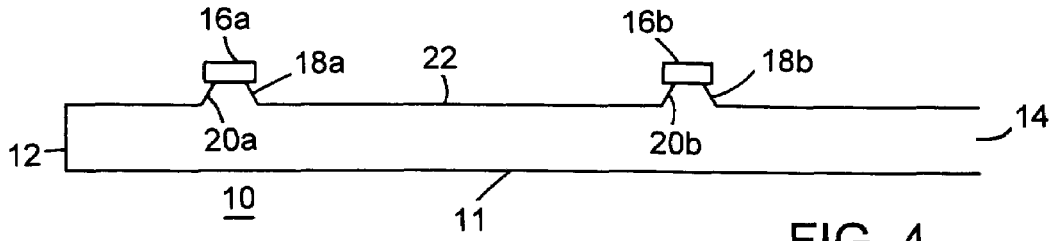
FIG. 4 is a diagrammatic cross section of a third embodiment of the invention.

Referring to FIG. 4, there is shown a third waveguide system according to the invention. Waveguide system 10 includes an acoustic waveguide 11 that is a tubular structure that has a terminal end 12 and an open end 14. Terminal end 12 is terminated by an acoustically reflective surface. Mounted in a wall 22 of the waveguide 11 is a first acoustic driver 16*a* at a position between the terminal end 12 and the effective midpoint of the waveguide, with one radiating surface (in this case back side 18*a*) of the first acoustic driver 16*a* facing free air and the other radiating surface (in this case front side 20*a*) of the first acoustic driver 16*a* facing into acoustic waveguide 11. Additionally, a second acoustic driver 16*b* is mounted in a wall 22 of the waveguide 11, with one radiating surface (in this case back side 18*b*) of the second acoustic driver 16*b* facing free air and the other radiating surface (in this case front side 20*b*) of the acoustic driver facing into acoustic waveguide 11. The second acoustic driver 16*b* is mounted at a point between the first acoustic driver 16*a* and the open end 14 of the waveguide, and is electronically coupled in phase to the same audio signal source as first acoustic driver 16*a*. The mounting point of the second waveguide 16*b* is set such that radiation of second acoustic driver 16*b* opposes radiation from first acoustic driver 16*a* when acoustic drivers 16*a* and 16*b* radiate sound waves of wavelength equal to the effective length of waveguide 11. As a result of the opposition, there is significantly reduced radiation from acoustic waveguide 11. Since there is significantly reduced radiation from the acoustic waveguide 11, the sound waves radiated into free air by the back side 18*a* of first acoustic driver 16*a* and the back side 18*b* of second acoustic driver 16*b* are not opposed by radiation from the waveguide.

If the waveguide has a relatively uniform cross section, the distance between first acoustic driver 16*a* and second acoustic driver 16*b* will be about a 0.5L, where L is the effective length of the waveguide. For waveguides with nonuniform cross-sectional areas, the distance between second acoustic driver 16*b* and first acoustic driver 16*a* can be determined by mathematical calculation, by computer modeling, or empirically.

Figure 5:
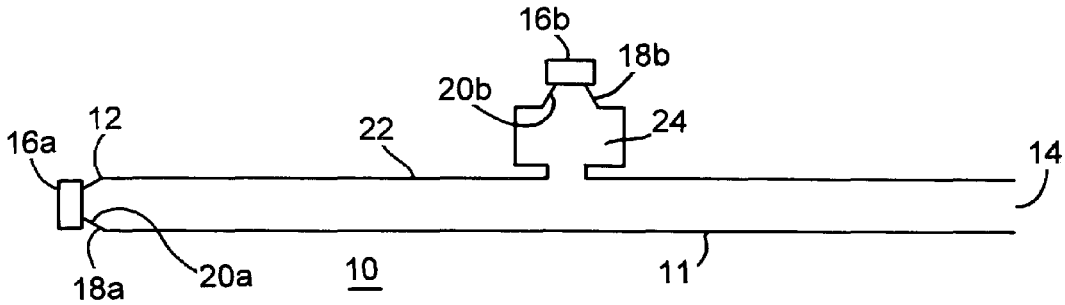
FIG. 5 is a diagrammatic cross section of a fourth embodiment of the invention.

Referring to FIG. 5, there is shown a fourth waveguide system according to the invention. Waveguide system 10 includes an acoustic waveguide 11 that is a tubular structure that has a terminal end 12 and an open end 14. Terminal end 12 is terminated by a first acoustic driver 16*a* mounted in the end, with one radiating surface (in this case back side 18*a*) of the first acoustic driver 16*a* facing free air and the other radiating surface (in this case front side 20*a*) of the first acoustic driver 16*a* facing into the acoustic waveguide 11. Additionally, a second acoustic driver 16*b* is mounted in a wall 22 of waveguide 11, with one radiating surface (in this case back side 18*b*) of the second acoustic driver 16*b* facing free air and the other radiating surface (in this case front side 20*b*) of acoustic driver acoustically coupled to the acoustic waveguide 11 by acoustic volume 24 at a point such that acoustic radiation from second driver 16*b* and acoustic radiation from first driver 16*a* oppose each other when first and second drivers 16*a* and 16*b* radiate sound waves with a wavelength equal to the effective length L or waveguide 11. First and second acoustic drivers 16*a* and 16*b* are connected in phase to the same signal source (signal source and connections not shown). As a result of the opposition, there is significantly reduced radiation from acoustic waveguide 11. Since there is significantly reduced radiation from acoustic waveguide 11, the sound waves radiated into free air by the back side 18*a* of first acoustic driver 16*a* and the back side 18*b* of second acoustic driver 16*b* of the acoustic driver are not opposed by radiation from the waveguide. Acoustic volume 24 acts as an acoustic low-pass filter so that the sound radiation from second acoustic driver 16*b* into acoustic waveguide 11 is significantly attenuated at higher frequencies. The embodiment of FIG. 5 damps output peaks at higher frequencies.

The principles of the embodiment of FIG. 5 can be implemented in the embodiment of FIG. 4 by coupling one of acoustic drivers 16*a* or 16*b* by an acoustic volume such as acoustic volume 24 of FIG. 5.

Figure 6:
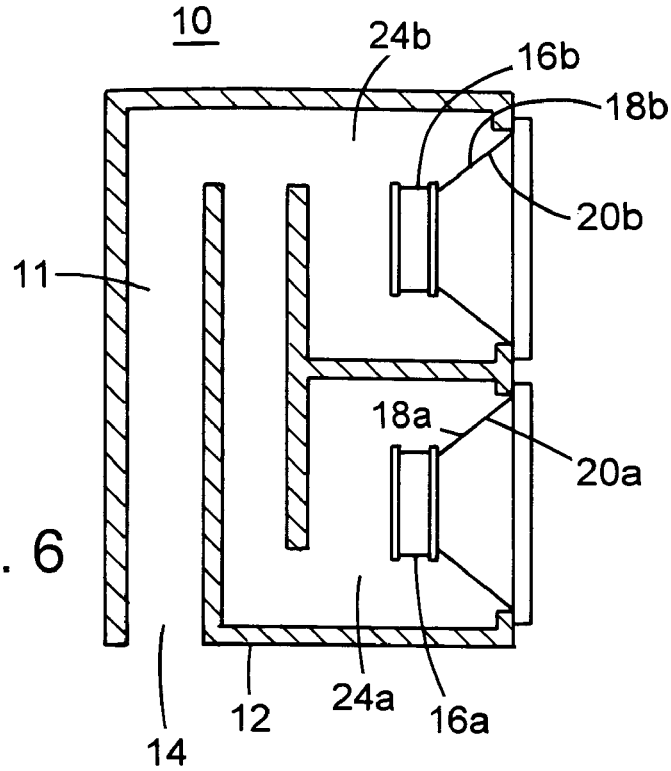
FIG. 6 is a diagrammatic cross section of a generalized form of a fifth embodiment of the invention.

Referring now to FIG. 6, there is shown another embodiment of the invention, combining the principles of the embodiments of FIGS. 3 and 5. Waveguide system 10 includes an acoustic waveguide 11 that is a tubular structure that has a terminal end 12 and an open end 14. Terminal end 12 is terminated by a first acoustic driver 16*a* mounted in the end, with one radiating surface (in this case front side 20*a*) of the first acoustic driver 16*a* facing free air and the other radiating surface (in this case back side 18*a*) of the first acoustic driver 16*a* acoustically coupled to the terminal end 12 of acoustic waveguide 11 by acoustic volume 24*a*. Additionally, a second acoustic driver 16*b* is mounted in a wall 22 of waveguide 11, with one radiating surface (in this case front side 20*b*) of the second acoustic driver 16*b* facing free air and the other radiating surface (in this case back side 18*b*) of the acoustic driver acoustically coupled to acoustic waveguide 11 by acoustic volume 24*b* at the effective midpoint of the waveguide. First and second acoustic drivers 16*a* and 16*b* are connected in phase to the same signal source (signal source and connections not shown). When first and second acoustic drivers 16*a* and 16*b* radiate a sound wave having a frequency equal to the opposition frequency, the sound wave radiated by second acoustic driver 16*b* and the sound wave radiated by acoustic driver 16*a* oppose each other. As a result of the opposition, there is significantly reduced radiation from acoustic waveguide 11. Since there is little radiation from the acoustic waveguide 11, the sound waves radiated into free air by the front side 20*a* of first acoustic driver 16*a* and the front side 20*b* of second acoustic driver 16*b* of the acoustic driver are not opposed by radiation from the waveguide, and the cancellation problem at the cancellation frequency $f$ (and at the even multiples of frequency $f$) is greatly mitigated. Acoustic volumes 24*a* and 24*b* act as acoustic low-pass filters so that the sound radiation into the waveguide is significantly attenuated at higher frequencies, damping the high frequency output peaks.

The principles of the embodiment of FIG. 6 can be implemented in the embodiment of FIG. 4 by coupling acoustic drivers 16*a* and 16*b* to waveguide 11 by acoustic volumes such as the acoustic volumes 24*a* and 24*b* of FIG. 6.

Figure 7:
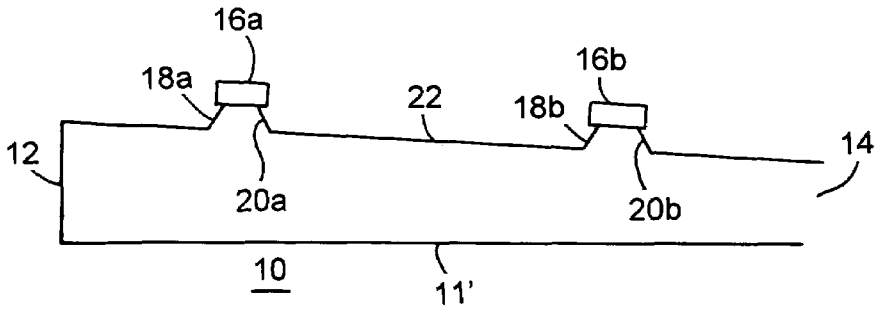
FIG. 7 is a diagrammatic cross section of a sixth embodiment of the invention.

Referring now to FIG. 7, there is shown another embodiment of the invention. Waveguide system 10 includes an acoustic waveguide 11' that is tapered as disclosed in U.S. patent application Ser. No. 09/146,662 and embodied in the Bose Wave radio/CD. Terminal end 12 is terminated by an acoustically reflective surface. Mounted in a wall 22 of waveguide 11 is a first acoustic driver 16*a* mounted at a position between the terminal end 12 and the effective midpoint of the waveguide. First acoustic driver 16*a* may also be mounted in terminal end 12. One radiating surface (in this case back side 18*a*) of the first acoustic driver 16*a* faces free air, and the other radiating surface (in this case front side 20*a*) of the first acoustic driver 16*a* faces into the acoustic waveguide 11. Additionally, a second acoustic driver 16*b* is mounted in a wall 22 of the waveguide 11, with one radiating surface (in this case back side 18*b*) of the second acoustic driver 16*b* facing free air and the other radiating surface (in this case front side 20*b*) of the acoustic driver facing into the acoustic waveguide 11. First and second acoustic drivers 16*a* and 16*b* are connected in phase to the same signal source (signal source and connections not shown). The second acoustic driver 16*b* is spaced by a distance such that when first and second acoustic drivers 16*a* and 16*b* radiate sound waves of a frequency equal to the dip frequency into waveguide 11, they oppose each other. As a result of the opposition, there is significantly reduced radiation from the acoustic waveguide 11. Since there is significantly reduced radiation from acoustic waveguide 11, the sound waves radiated into free air by the back side 18*a* of first acoustic driver 16*a* and the back side 18*b* of second acoustic driver 16*b* of the acoustic driver are not opposed by radiation from the waveguide.

In a tapered waveguide, or other waveguides with nonuniform cross sections, the effective midpoint (as defined in the discussion of FIG. 3) may differ from the geometric halfway point of the waveguide. For waveguides with nonuniform cross sections the effective midpoint may be determined by mathematical calculation, by computer simulation, or empirically.

Figure 8:
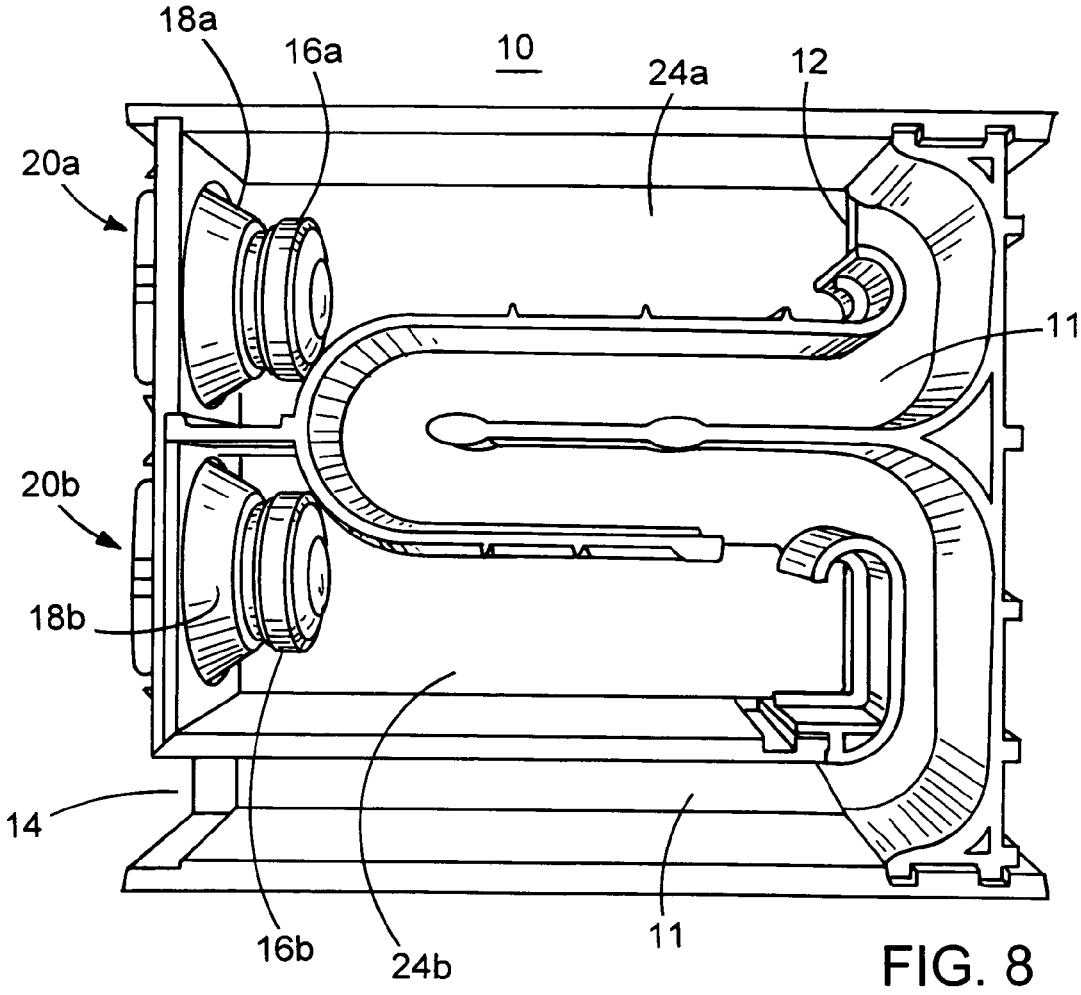
FIG. 8 is a wire frame drawing of an embodiment of the invention.

Referring now to FIG. 8, there is shown a cutaway perspective view of an exemplary electroacoustical waveguide system according to the invention. The waveguide system of FIG. 8 uses the implementation of FIG. 6, with the FIG. 8 implementation of the elements of FIG. 6 using common identifiers. In the implementation of FIG. 8, waveguide 11 has a substantially uniform cross sectional area of 12.9 square inches and a length of 25.38 inches. The acoustic volumes 24*a* and 24*b* have a volume of 447 cubic inches and 441 cubic inches, respectively, and the acoustic drivers are 5.25 inch 3.8 ohm drivers available commercially from Bose Corporation of Framingham, Mass.

Figure 9:
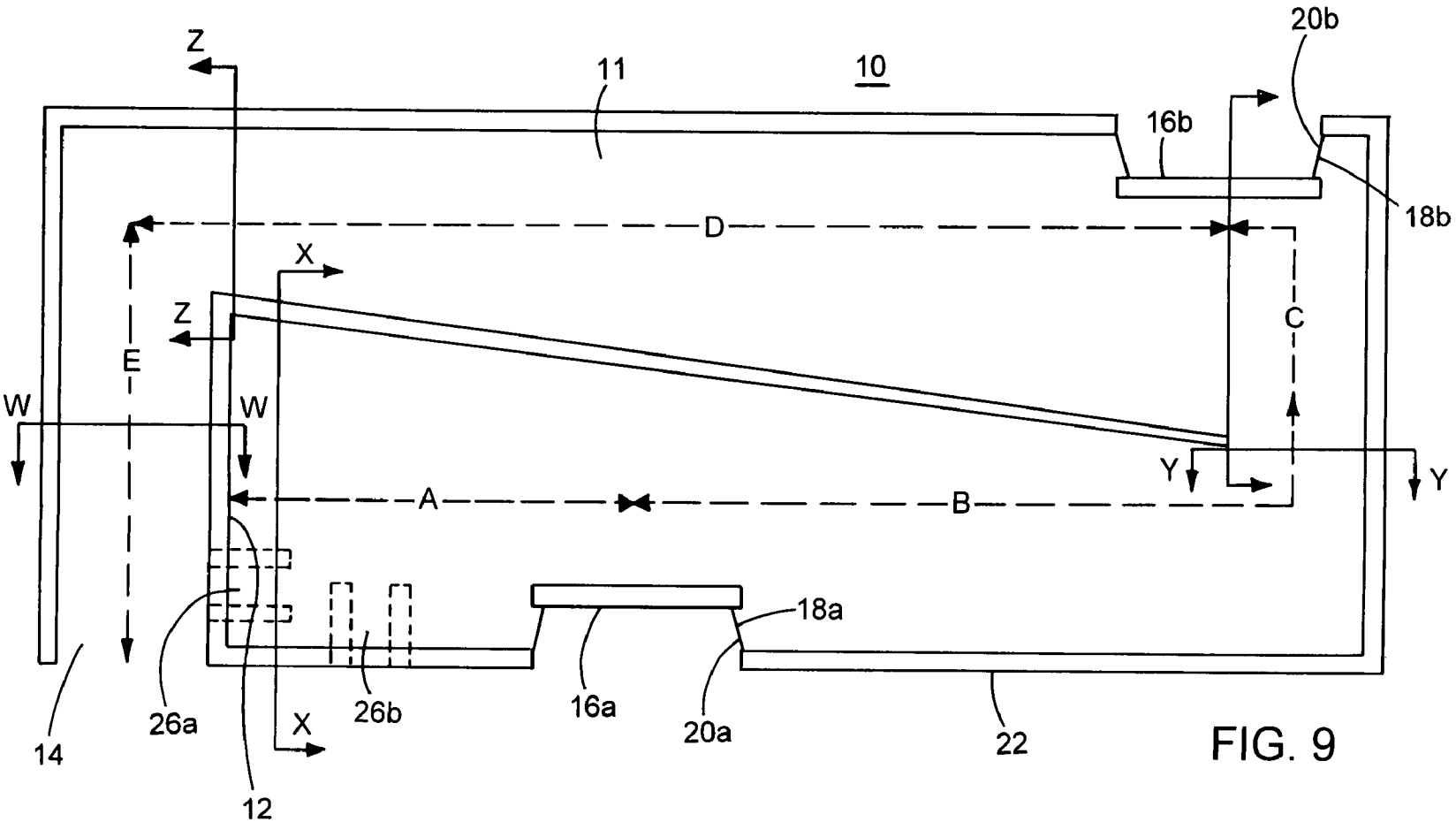
FIG. 9 is a diagrammatic cross section of a second embodiment of the invention.

Referring to FIG. 9, there is shown a cross section of another electroacoustical waveguide system according to the invention. In FIG. 9, identifiers refer to common elements of FIGS. 2-8. Waveguide 11 has two tapered sections, with a first section 11*a* having a cross section of 36.0 square inches at section X-X, 22.4 square inches at section Y-Y, 28.8 square inches at section Z-Z, 22.0 square inches at section W-W, and 38.5 square inches at section V-V. Length A is 10.2 inches, length B is 27.8 inches, length C is 4.5 inches, length D is 25.7 inches, and length E is 10.4 inches. Acoustic drivers 16*a* and 16*b* are 6.5 inch woofers available commercially from Bose Corporation of Framingham, Mass. To adjust acoustic parameters of the waveguide system, there may be an optional port 26*a* or 26*b* (dotted lines) and there may be acoustic absorbent material in the waveguide 11, such as near the terminal end 12 of the waveguide 11.

Figure 10:
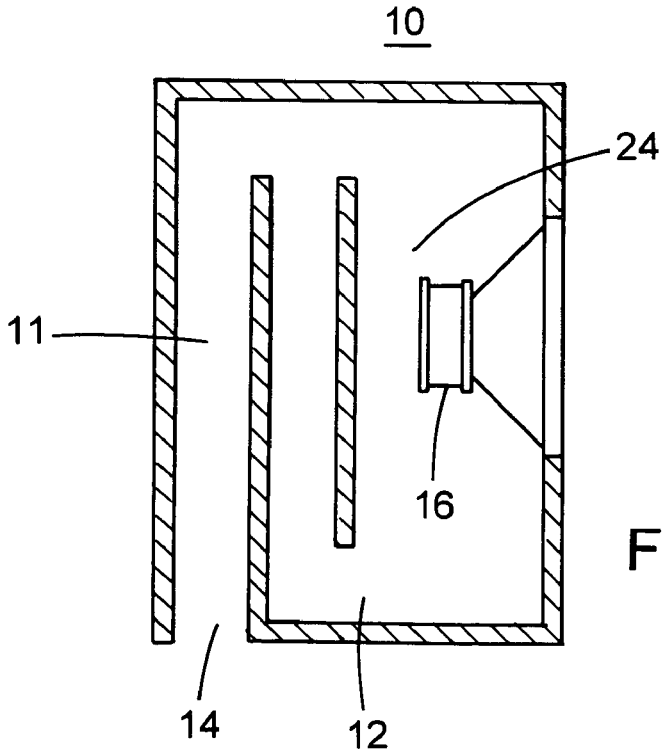
FIG. 10 is a diagrammatic cross section of another embodiment of the invention.

Referring to FIG. 10, there is shown another embodiment of the invention. The embodiment of FIG. 10 uses the topology of the embodiment of FIG. 8, but is constructed and arranged so that a single acoustic driver 16 performs the function of both acoustic drivers 16*a* and 16*b* of the embodiment of FIG. 6. If desired, the acoustic driver 16 can be replaced by more than one acoustic driver coupled to waveguide 11 by a common acoustic volume 24.

Other embodiments are within the claims.

What is claimed is:

1. An electroacoustic waveguide system, comprising:

an acoustic waveguide having an open end and an interior;

a first acoustic driver connected to said acoustic waveguide having a first radiating surface and a second radiating surface, constructed and arranged so that said first radiating surface radiates sound waves into free air and said second radiating surface radiates sound waves into said acoustic waveguide so that sound waves are radiated at said open end, into free air that would ordinarily oppose the radiation from said first surface at a dip frequency; and a source of opposing sound waves in said acoustic waveguide for opposing a predetermined spectral component corresponding to said dip frequency of said sound waves radiated into said acoustic waveguide to oppose the acoustic radiation of said predetermined spectral component from said acoustic waveguide so that the combined radiation into free air from said first radiating surface and said open end is free from appreciable reduction in radiation at said dip frequency.

2. An electroacoustic waveguide system in accordance with claim 1, further comprising an acoustic port, coupling said interior with free air.

3. An electroacoustic waveguide system in accordance with claim 1, wherein said source of opposing sound waves comprises a second acoustic driver arranged and constructed to radiate sound waves into said acoustic waveguide.

4. An etectroacoustic waveguide system in accordance with claim 3, further comprising an acoustic port, coupling said interior with free air.

5. An electroacoustic waveguide system in accordance with claim 4, wherein said acoustic waveguide has a closed end and said acoustic port is positioned between said first acoustic driver and said closed end of said acoustic waveguide.

6. An electroacoustie waveguide system in accordance with claim 1, wherein said predetermined spectral component comprises a dip frequency at which said waveguide system produces an acoustic null, absent said source of opposing sound waves.

7. An electroacoustic waveguide system in accordance with claim 6, wherein said source of opposing sound waves comprises a second acoustic driver arranged and constructed to radiate sound waves into said acoustic waveguide.

8. An electroacoustic waveguide system, comprising:

an acoustic waveguide having an open end and a closed end and further having an effective length;

an acoustic driver having a first radiating surface constructed and arranged to radiate sound waves into tree air and a second radiating surface for radiating sound waves into said waveguide so that sound waves are radiated at said open end into free air that would ordinarily oppose the radiation from said first surface at a dip frequency, a source of opposing sound waves positioned in said acoustic waveguide so that there is an acoustic null at said open end at said dip frequency so that the combined radiation into free air from said first radiating surface and said open end is free from appreciable reduction in radiation at said dip frequency.

9. An electroacoustic waveguide system in accordance with claim 1, said acoustic waveguide having a substantially constant cross section, wherein said acoustic driver positioned at a distance substantially 0.25 L from said closed cad of said waveguide, where L is the effective length of said waveguide.

10. An electroacoustic waveguide system in accordance with claim 9, wherein said closed end is a surface that is acoustically reflective at said dip frequency.

11. An electroacoustic waveguide system in accordance with claim 1, wherein said source of opposing sound waves comprises a reflective surface inside said acoustic waveguide, positioned so that sound waves reflected from said reflective surface oppose said sound waves radiated directly into said acoustic waveguide by said second radiating surface.

12. An electroacoustic waveguide system in accordance with claim 6, wherein said source of opposing sound waves comprises a reflective surface inside said acoustic waveguide, positioned so that sound waves reflected from said reflective surface opposes said sound waves radiated directly into said acoustic waveguide by said second radiating surface.

* * * * *